US010852031B2

(12) United States Patent
Kim et al.

(10) Patent No.: US 10,852,031 B2
(45) Date of Patent: Dec. 1, 2020

(54) AIR CONDITIONER AND METHOD FOR CONTROLLING THE SAME

(71) Applicant: SAMSUNG ELECTRONICS CO., LTD., Suwon-si (KR)

(72) Inventors: Tae Woo Kim, Suwon-si (KR); Min Seok Kim, Suwon-si (KR); Jong Woon Kim, Suwon-si (KR); Seung Jun Park, Suwon-si (KR); Seong Kyu Lee, Seoul (KR); Hee-Chan Kang, Suwon-si (KR); Chi Wook Gu, Suwon-si (KR); Tae Hyun Kim, Hwaseong-si (KR); Hyeong Joon Seo, Suwon-si (KR); Jung Yong Sung, Suwon-si (KR); Sun-Hee Son, Suwon-si (KR); Hong Seok Jun, Suwon-si (KR); Seung Yeon Han, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 79 days.

(21) Appl. No.: 16/029,906

(22) Filed: Jul. 9, 2018

(65) Prior Publication Data

US 2019/0017725 A1 Jan. 17, 2019

(30) Foreign Application Priority Data

Jul. 12, 2017 (KR) ..... 10-2017-0088164

(51) Int. Cl.
*F25D 21/00* (2006.01)
*F25B 47/02* (2006.01)
(Continued)

(52) U.S. Cl.
CPC ..... *F24F 13/222* (2013.01); *F24F 11/77* (2018.01); *F24F 2013/225* (2013.01); *F24F 2221/54* (2013.01)

(58) Field of Classification Search
CPC ..... F25B 2600/01; F25B 2600/11; F25B 2600/111; F25B 2600/112;
(Continued)

(56) References Cited

U.S. PATENT DOCUMENTS 5,931,011 A * 8/1999 Shima ..... F25D 17/062 165/269
2012/0318007 A1* 12/2012 Lukasse ..... F25B 49/02 62/89
(Continued)

FOREIGN PATENT DOCUMENTS

JP 9-126521 5/1997
KR 1994-0018631 8/1994
(Continued)

OTHER PUBLICATIONS

International Search Report dated Nov. 7, 2018 in International Patent Application No. PCT/KR2018/007859.

*Primary Examiner* — Frantz F Jules
*Assistant Examiner* — Erik Mendoza-Wilkenfel
(74) *Attorney, Agent, or Firm* — Staas & Halsey LLP

(57) ABSTRACT

An air conditioner and a method for controlling the same are disclosed. The air conditioner includes a compressor; an indoor fan configured to blow an indoor air; and a controller configured to change and control a revolutions per minute (RPM) of the indoor fan to a predetermined time when the compressor is off.

14 Claims, 10 Drawing Sheets

(51) Int. Cl.
*F24F 13/22* (2006.01)
*F24F 11/77* (2018.01)

(58) Field of Classification Search
CPC .. F25B 2600/0251; F25B 47/02; F25D 21/00; F25D 21/004; F25D 21/006; F25D 21/008
See application file for complete search history.

(56) References Cited

U.S. PATENT DOCUMENTS

| | | | | |
|---|---|---|---|---|
| 2013/0180690 | A1 | 7/2013 | Yura et al. | |
| 2014/0360212 | A1* | 12/2014 | Bae | F25B 49/02 62/89 |

FOREIGN PATENT DOCUMENTS

| | | |
|---|---|---|
| KR | 1998-028575 | 7/1998 |
| KR | 10-0187222 | 5/1999 |
| KR | 10-2006-0158531 | 12/2006 |
| KR | 10-2008-0101118 | 11/2008 |
| KR | 10-2014-0124682 | 10/2014 |

* cited by examiner

[AMOUNT OF DRAIN(cc)]

| MINUTE | 0 | 1 | 2 | 3 | 5 | 10 |
|---|---|---|---|---|---|---|
| FAN OFF | 0 | 65 | 130 | 170 | 210 | 250 |
| TURBO OPERATION | 0 | 45 | 90 | 128 | 160 | 176 |

AIR CONDITIONER AND METHOD FOR CONTROLLING THE SAME

CROSS-REFERENCE TO RELATED APPLICATION

This application is based on and claims priority under 35 U.S.C. § 119 to Korean Patent Application No. 10-2017-0088164, filed on Jul. 12, 2017 in the Korean Intellectual Property Office, the disclosure of which is incorporated by reference in its entirety.

BACKGROUND

1. Field

Embodiments of the present disclosure relate to an air conditioner and a method for controlling the same.

2. Description of the Related Art

An air conditioner is an apparatus that cools or heats indoor air. The air conditioner performs a cooling by using the characteristic of absorbing the surrounding heat when a liquid refrigerant vaporizes, and performs a heating by using the characteristic of releasing heat when a gaseous refrigerant liquefies.

A typical air conditioner generally connects a single indoor unit to a single outdoor unit. However, in recent times, demand for a system air conditioner which connects a plurality of indoor units having various types and capacities to a single outdoor unit, is increasing.

Currently, the air conditioner performs a cleaning operation by operating an indoor fan when a compressor is off during a cooling operation. At this time, the condensate generated in a heat-exchanger during the cooling operation is rapidly evaporated, causing a hydrophilic odor, which may cause a user to feel uncomfortable.

SUMMARY

Therefore, it is an aspect of the present disclosure to provide an air conditioner capable of smoothly draining and evaporating condensate remaining in an indoor heat-exchanger after a compressor is turned off, and a method for controlling the same.

Additional aspects of the disclosure will be set forth in part in the description which follows and, in part, will be obvious from the description, or may be learned by practice of the disclosure.

In accordance with an aspect of the present disclosure, an air conditioner includes: a compressor; an indoor fan configured to blow an indoor air; and a controller configured to change and control a revolutions per minute (RPM) of the indoor fan to a predetermined time when the compressor is turned off.

When a plurality of indoor fans is provided, the controller may operate only a predetermined lower indoor fan from among the plurality of indoor fans is driven for a first time when the compressor is off, and operate the plurality of indoor fans for a second time when the first time is exceeded.

The controller may operate only the lower indoor fan at a minimum RPM when operating only the lower indoor fan.

The controller may set the RPMs of the plurality of indoor fans such that an indoor fan disposed at a lower side among the plurality of indoor fans has a greater value of RPM when operating the plurality of indoor fans.

When a single indoor fan is provided, the controller may operate the indoor fan at a minimum RPM for a first time when the compressor is turned off, and operate the indoor fan to a value larger than the minimum RPM for a second time when the first time is exceeded.

The controller may operate the indoor fan in a weak wind mode for the first time, and operates the indoor fan in a strong wind mode or a turbo mode for the second time.

In accordance with another aspect of the present disclosure, an air conditioner includes: a compressor; an indoor fan configured to blow an indoor air; and a controller configured to maintain the indoor fan in a stop state for a first time when the compressor is turned off, and operate the indoor fan at a predetermined revolutions per minute (RPM) for a second time when the first time is exceeded.

When a plurality of indoor fans is provided, the controller may set the RPMs of the plurality of indoor fans such that an indoor fan disposed at a lower side among the plurality of indoor fans has a greater value of RPM when operating the indoor fan is operated at the predetermined RPM.

In accordance with another aspect of the present disclosure, a method for controlling an air conditioner includes: performing a cooling operation; and changing and controlling a revolutions per minute (RPM) of an indoor fan to a predetermined time when a compressor is turned off.

When a plurality of indoor fans is provided, the changing and controlling of the RPM of the indoor fan to the predetermined time may include operating only a predetermined lower indoor fan from among the indoor fans for a first time; and operating the plurality of indoor fans for a second time when the first time is exceeded.

The changing and controlling of the RPM of the indoor fan to the predetermined time may further include operating only the lower indoor fan at a minimum RPM.

The changing and controlling of the RPM of the indoor fan to the predetermined time may further include setting the RPMs of the plurality of indoor fans such that an indoor fan disposed at a lower side among the plurality of indoor fans has a greater value of RPM when operating the plurality of indoor fans.

When a single one indoor fan is provided, the changing and controlling of the RPM of the indoor fan to the predetermined time may include operating the indoor fan at a minimum RPM for a first time; and operating the indoor fan to a value larger than the minimum RPM for a second time when the first time is exceeded.

The operating of the indoor fan at the minimum RPM for the first time may include operating the indoor fan in a weak wind mode for the first time, and the operating of the indoor fan to the value larger than the minimum RPM for the second time may include operating the indoor fan in a strong wind mode or a turbo mode for the second time.

In accordance with another aspect of the present disclosure, a method for controlling an air conditioner includes: performing a cooling operation; maintaining an indoor fan in a stop state for a first time when a compressor is turned off; and operating the indoor fan at a predetermined revolutions per minute (RPM) for a second time when the first time is exceeded.

When a plurality of indoor fans is provided, the operating of the indoor fan at the predetermined RPM may include setting the RPMs of the plurality of indoor fans such that an indoor fan disposed at a lower side among the plurality of indoor fans has a greater value of RPM.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
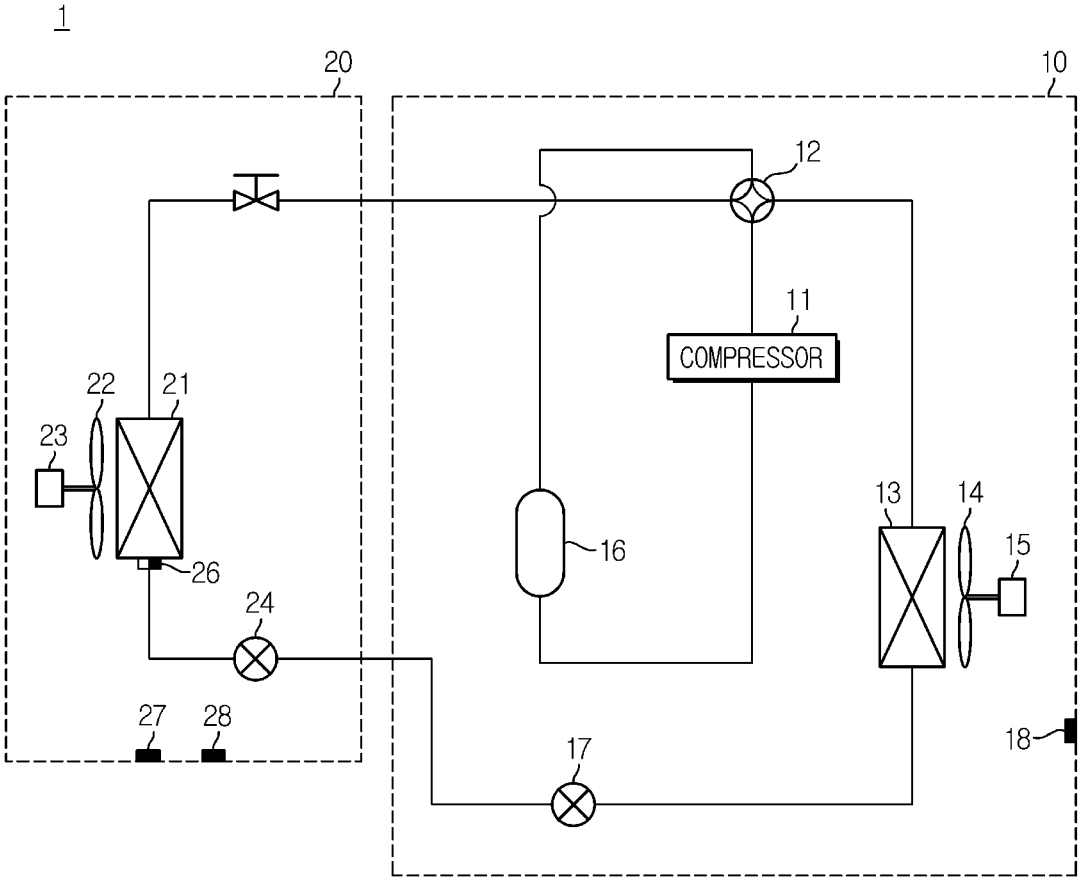
FIG. 1 is a view illustrating a configuration of an air conditioner.

Like numerals refer to like elements throughout the specification. Not all elements of embodiments of the present disclosure will be described, and description of what are commonly known in the art or what overlap each other in the embodiments will be omitted. The terms as used throughout the specification, such as "~part", "~module", "~member", "~block", etc., may be implemented in software and/or hardware, and a plurality of "~parts", "~modules", "~members", or "~blocks" may be implemented in a single element, or a single "~part", "~module", "~member", or "~block" may include a plurality of elements.

It will be further understood that the term "connect" or its derivatives refer both to direct and indirect connection, and the indirect connection includes a connection over a wireless communication network.

The term "include (or including)" or "comprise (or comprising)" is inclusive or open-ended and does not exclude additional, unrecited elements or method steps, unless otherwise mentioned.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section.

It is to be understood that the singular forms "a," "an," and "the" include plural references unless the context clearly dictates otherwise.

Reference numerals used for method steps are merely used for convenience of explanation, but not to limit an order of the steps. Thus, unless the context clearly dictates otherwise, the written order may be practiced otherwise.

The principle and exemplary embodiments of the present disclosure will now be described with reference to accompanying drawings.

Further, the air conditioner described below can be applied to all types of air conditioners, such as a stand type, a wall-mounted type, and a system type FIG. 1 is a view illustrating a configuration of an air conditioner.

Referring to FIG. 1, an air conditioner 1 may include an outdoor unit 10 and an indoor unit 20. Although not shown, the outdoor unit 10 and the indoor unit 20 may include a communicator to transmit and receive power and communication signals to each other.

The outdoor unit 10 may include a compressor 11 to compress refrigerant into high-temperature high-pressure gas state, a four-way valve 12 to switch flow of the high-temperature high-pressure gaseous refrigerant compressed in the compressor 11, an outdoor heat-exchanger 13 to receive the high-temperature high-pressure gaseous refrigerant compressed in the compressor 11 and exchange heat with outdoor air, an outdoor fan 14 to forcedly blow outdoor air by an outdoor fan motor 15 so that heat exchange is performed in the outdoor heat-exchanger 13, and an electronic expansion valve 17 to decompress and expand the heat exchanged refrigerant while controlling the refrigerant flow rate. At this time, the electronic expansion valve (EEV) 17 may control the superheating degree and the supercooling degree of the refrigerant according to the opening degree.

An accumulator 16 may be provided on a suction side of the compressor 11 to convert the refrigerant flowing into the compressor 11 into a gas in a fully gaseous state.

In addition, the outdoor unit 10 may include an outdoor temperature sensor 18 to detect a temperature of the outdoor air. At this time, the outdoor temperature sensor 18 may be provided at any place where the temperature of the outdoor air can be sensed or where the outdoor temperature sensing is required by an operator.

Further, the indoor unit 20 may include an indoor heat-exchanger 21 to receive the refrigerant and exchange heat with the indoor air and an indoor fan 22 to forcedly blow the indoor air by an indoor fan motor 15 so that heat exchange is performed in the indoor heat-exchanger 21.

In addition, among the pipes connected to the indoor heat-exchanger 21, an inlet pipe in which the refrigerant is sucked during the cooling operation may be provided with an electronic expansion valve 24 to expand the refrigerant and an indoor heat-exchanger temperature sensor 26 to detect a temperature of the inlet pipe of the indoor heat-exchanger 21.

In addition, the indoor unit 20 may further include an indoor humidity sensor 27 to detect an indoor humidity. The indoor humidity sensor 27 may detect the relative humidity in the air flowing into the indoor unit 20, but is not limited thereto. Therefore, the indoor humidity sensor 27 may vary according to the needs of the operator. At this time, the indoor humidity sensor 27 may be provided at any place where the indoor humidity can be sensed or where the indoor humidity sensing is required by an operator.

In addition, the indoor unit 20 may further include an indoor temperature sensor 28 to detect a temperature of the indoor air. At this time, the indoor temperature sensor 28 may be provided at any place where the temperature of the indoor air can be sensed or where the indoor temperature sensing is required by an operator.

Figure 2:
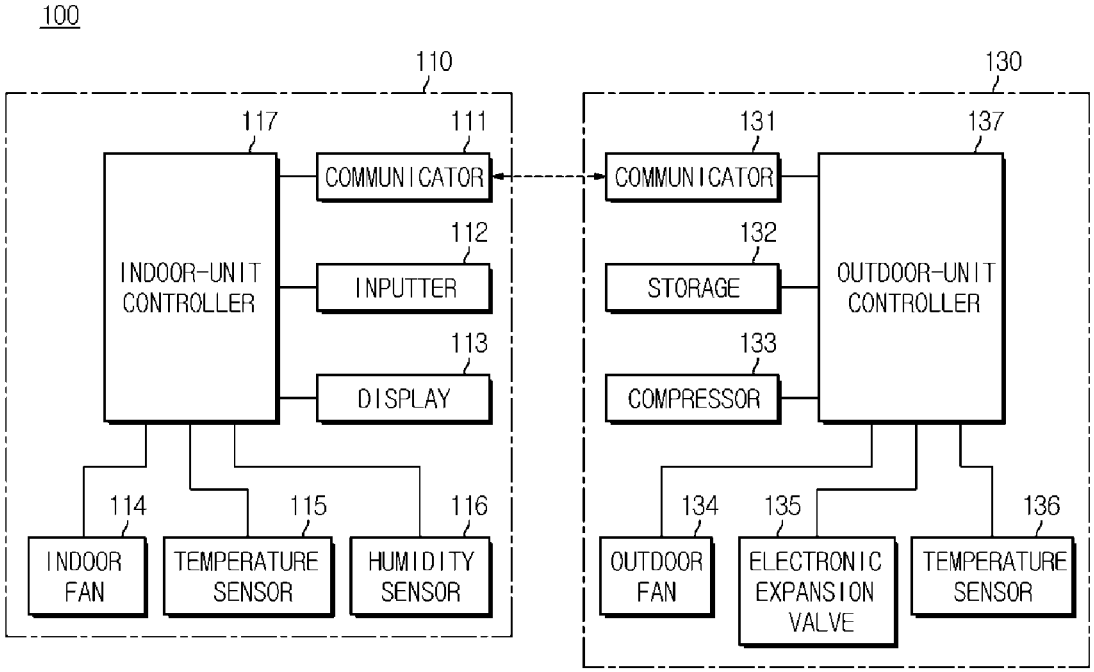
FIG. 2 is a view illustrating in detail a control block diagram of the air conditioner.

FIG. 2 is a view illustrating in detail a control block diagram of the air conditioner.

The following description will be made with reference to FIGS. 3 and 4 for illustrating a control method of changing the RPM of the indoor fan, FIGS. 5 and 6 for illustrating the principle of odor generation, and FIG. 7 for illustrating a time of changing the RPM of the indoor fan.

Referring to FIG. 2, the air conditioner 100 may include an indoor unit 110 provided with a communicator 111, an inputter 112, a display 113, an indoor fan 114, a temperature sensor 115, a humidity sensor 116, and an indoor-unit controller 117.

The air conditioner 100 may further include an outdoor unit 130 provided with a communicator 131, a storage 132, a compressor 133, an outdoor fan 134, an electronic expansion valve 135, a temperature sensor 136, and an outdoor-unit controller 137.

First, the communicator 111 may be configured to transmit and receive power and communication signals between the indoor unit 110 and the outdoor unit 130.

The communicators 111 and 131 may include one or more components for enabling communication with an external device. For example, the communicators 111 and 131 may include at least one of a short-range communication module, a wired communication module, and a wireless communication module.

The short-range communication module may include various kinds of short-range communication modules, such as a Bluetooth module, an infrared communication module, a Radio Frequency Identification (RFID) communication module, a Wireless Local Access Network (WLAN) communication module, a Near Field Communication (NFC) module, a Zigbee communication module, and the like, which transmit/receive signals through a wireless communication network at a short range.

The wired communication module may include various cable communication modules, such as a Universal Serial Bus (USB), a High Definition Multimedia Interface (HDMI), a Digital Visual Interface (DVI), Recommended Standard-232 (RS-232), power line communication, Plain Old Telephone Service (POTS), and the like, as well as various kinds of wired communication modules, such as a Local Area Network (LAN) module, a Wide Area Network (WAN) module, a Value Added Network (VAN) module, and the like.

The wireless communication module may include wireless communication modules supporting various wireless communication methods, such as Global System for Mobile Communication (GSM), Code Division Multiple Access (CDMA), Wideband Code Division Multiple Access (WCDMA), Universal Mobile Telecommunications System (UMTS), Time Division Multiple Access (TDMA), Long Term Evolution (LTE), and the like, as well as a Wireless-Fidelity (Wi-Fi) module, and a Wireless Broadband module.

The inputter 112 may be a configuration for allowing a user to generate an operation command or to input a set value or the like for controlling the air conditioner 100.

The inputter 112 may include a hardware device, such as various buttons or switches, a keyboard, and the like for a user's input.

Also, the inputter 112 may include a Graphical User Interface (GUI) such as a touch pad, that is, a software device, for the user's inputs. The touch pad may be implemented as a Touch Screen Panel (TSP), and may be interlayered with the display 113.

In the case of the Touch Screen Panel (TSP) having the interlayered with the touch pad, the display 113 may also be used as the inputter 112.

The display 113 may be a configuration for visually displaying information related to the operation of the air conditioner 100 such as displaying a set temperature, a current temperature, a current humidity, a cooling mode, a reservation time, a fine dust concentration, and the like.

The display 113 may be a Cathode Ray Tube (CRT), a Digital Light Processing (DLP) panel, a Plasma Display Panel (PDP), a Light Crystal Display (LCD) panel, an Electro Luminescence (EL) panel, an Electrophoretic Display (EPD) panel, an Electrochromic Display (ECD) panel, a Light Emitting Diode (LED) panel, or an Organic Light Emitting Diode (OLED) panel, but is not limited thereto.

The indoor fan 114 may be configured to blow the indoor air.

The indoor fan 114 may forcibly blow the indoor air by the indoor fan motor 23 (see FIG. 1) so that heat exchange is performed in the indoor heat-exchanger 21 (see FIG. 1).

The indoor fan 114 may change the RPM of the indoor fan 114 according to a control signal transmitted from the indoor-unit controller 117.

The indoor fan 114 may be configured with one or more indoor fans. For example, when the applied air conditioner 100 is the wall-mounted type, the indoor fan 114 may be one, and when the air conditioner 100 is the stand type, the indoor fan 114 may be plural, but is not limited thereto.

The temperature sensor 115 may include an indoor heat-exchanger temperature sensor to detect the temperature of the indoor heat-exchanger and an indoor temperature sensor to detect the indoor temperature.

As shown in FIG. 1, the indoor heat-exchanger temperature sensor 26 may be installed at a position to detect the inlet pipe temperature of the indoor heat-exchanger 21, but the present disclosure is not limited to these, it is also possible to detect the temperature of the indoor heat-exchanger 21 at the position other than the inlet of the indoor heat-exchanger 21 according to the needs of the operator.

In addition, the indoor temperature sensor 28 (see FIG. 1) may be installed anywhere the temperature of the indoor air at which the air conditioner 100 is installed can be detected.

The humidity sensor 116 may be configured to detect the indoor humidity. The indoor humidity sensor 116 may be installed anywhere the humidity of the indoor at which the air conditioner 100 is installed can be detected.

The indoor-unit controller 117 may change the rotational speed of the indoor fan 114 to a predetermined time when the compressor 133 is turned off. At this time, the information related to the operation of the compressor 133 may be transmitted from the outdoor unit 130 through the communicator 111. At this time, the off the compressor 133 may be generated when a target temperature is reached (Thermo Off) or when the off command is inputted by the user's operation, but is not limited thereto.

Hereinafter, the case in which the plurality of indoor fans 114 is provided will be described as an example.

When the compressor 133 is turned off, the indoor-unit controller 117 may operate only a predetermined lower indoor fan among the indoor fans 114 for a first time. When the first time is exceeded, the indoor-unit controller 117 may operate the plurality of indoor fans 114 for a second time.

The indoor-unit controller 117 may operate the lower indoor fan with the minimum RPM when operating only the lower indoor fan.

Figure 3:
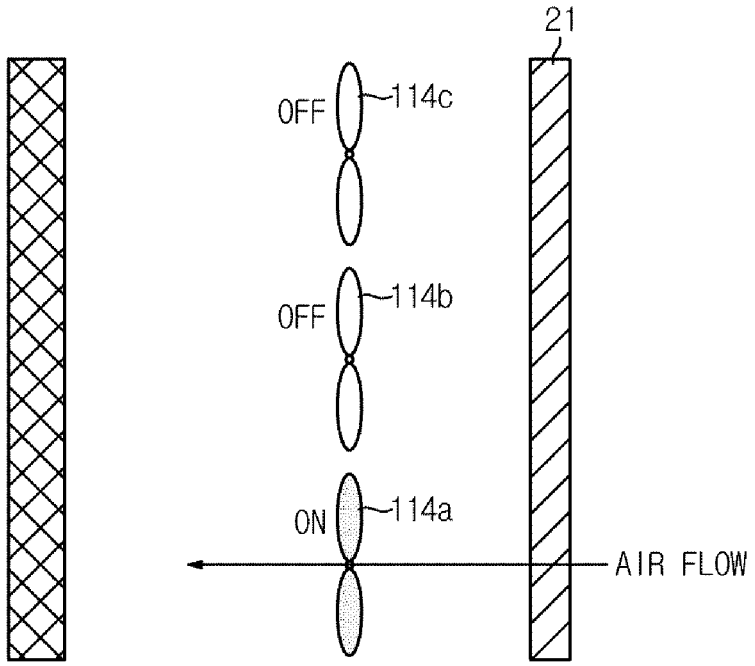
FIGS. 3 and 4 are views illustrating a control method for changing the revolutions per minute of an indoor fan.

Referring to FIG. 3, the indoor-unit controller 117 may operate only the predetermined lower indoor fan 114*a* among the indoor fans 114*a* to 114*c* at the minimum RPM immediately after the compressor is turned off, to prevent the spread of the odor which may occur due to the evaporation of the condensate remaining in the indoor heat-exchanger 21. At this time, the indoor fans 114*b* and 114*c* other than the lower indoor fan 114*a* may be maintained in the off state.

The indoor-unit controller 117 may set the RPMs of the plurality of indoor fans such that the indoor fan disposed at a lower side among the plurality of indoor fans has a greater value of RPM when operating the plurality of indoor fans.

Figure 4:
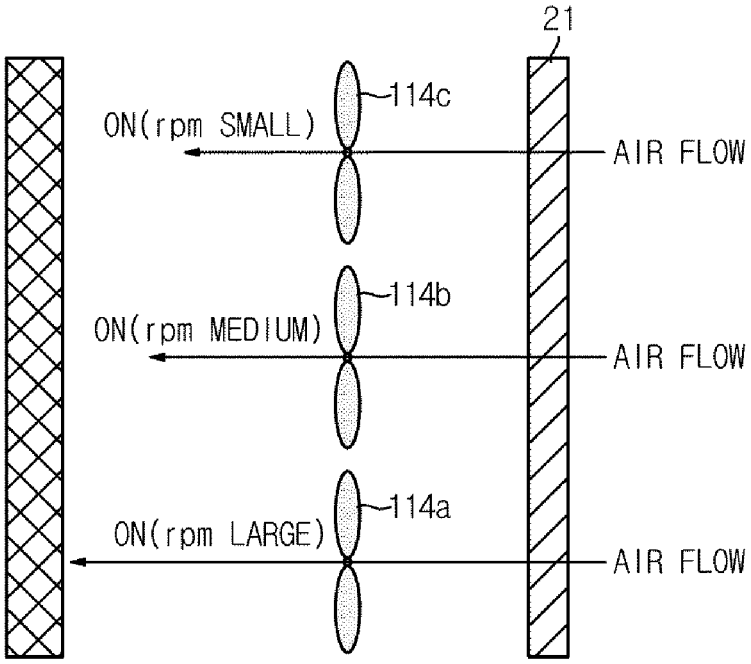

Referring to FIG. 4, the indoor-unit controller 117 may operate the plurality of indoor fans 114*a* to 114*c* when the first time is exceeded, so that the condensate remaining in the indoor heat-exchanger 21 can be quickly dried. At this time, the indoor-unit controller 117 may allow the rpm of the indoor fan 114 located in the lower portion of the indoor fans 114*a* to 114*c* to be larger in consideration of the amount of condensate remaining relatively more in the lower portion of the indoor heat-exchanger 21. For example, the indoor-unit controller 117 may control the size of the rpm as large→medium→small corresponding to one of the indoor fans 114*a*, 114*b*, and 114*c* in order, in FIG. 4.

Figure 5:
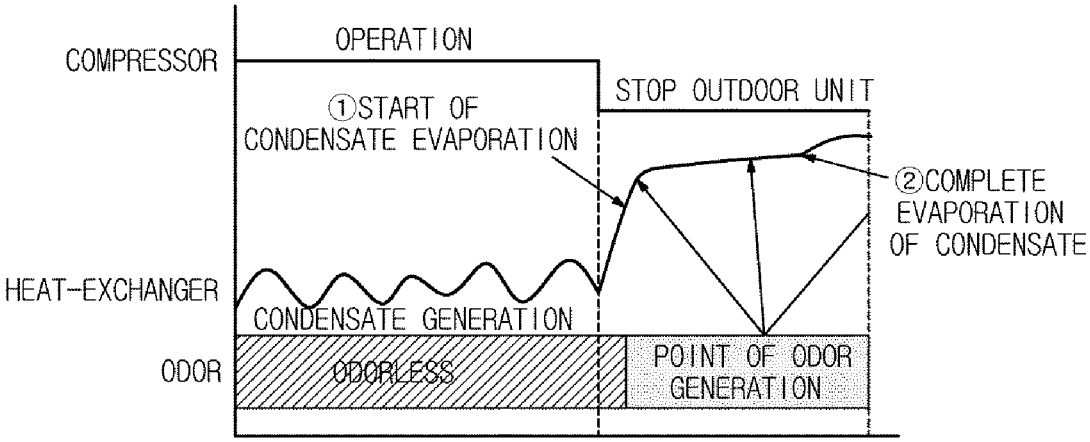
FIGS. 5 and 6 are views illustrating the principle of odor generation.

Referring to FIG. 5, the air conditioner 100 may generate the odor when the condensate remaining on the surface of the heat-exchanger evaporates after a certain time (for example, about 2 minutes) after the off operation of the compressor (stop of the outdoor unit in FIG. 5).

Figure 6:
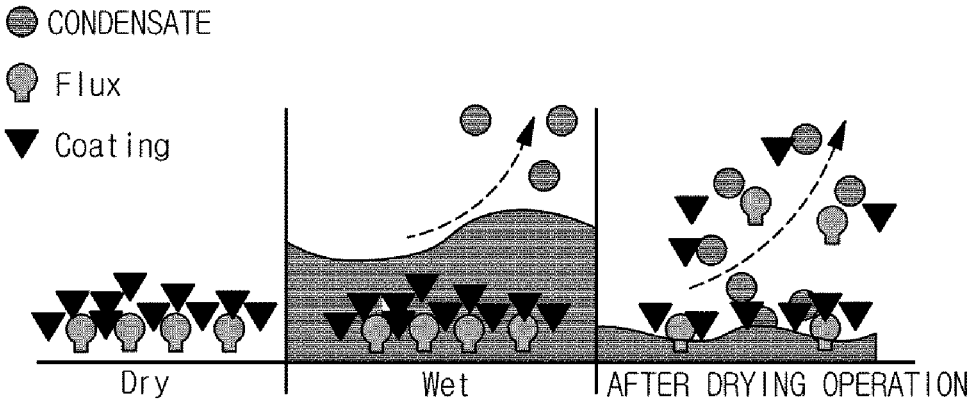

Referring to FIG. 6, in the dry state, a flux and a coating material, which cause the odor, are in a static state, and in the wet state in which the flux and the coating material combine with the condensate, only a part of the condensate may evaporate. After a drying operation in the air conditioner, the flux and the coating material, which are the cause of the odor may be evaporated together with the condensate, thereby generating the odor. In this case, a point of time when the odor causing factors together with the condensate evaporate due to the drying operation in the air conditioner may be a point of time when the odor occurs in FIG. 5.

The disclosed disclosure may apply the principle of minimizing the amount of evaporation by performing natural drainage to the point of occurrence of maximum natural drainage when the compressor of the air conditioner is turned off, thereby preventing the generation of the odor, and then drying the condensate which is not naturally drained by forced air blowing. That is, in the disclosed disclosure, natural drying is performed until the odor is generated after the compressor is turned off, and after the odor inducing time, active drying is performed by operating the indoor fan so as to completely dry the remaining condensate.

Hereinafter, the case where a single the indoor fan 114 is provided will be described as an example.

The indoor-unit controller 117 may operate the indoor fan 114 for the first time at the minimum RPM when the compressor 133 is turned off, and operate for the second time with a value larger than the minimum RPM when the first time is exceeded. At this time, the indoor-unit controller 117 may operate the indoor fan 114 in a weak wind mode for the first time and operate the indoor fan 114 in a strong wind mode or a turbo mode for the second time, but is not limited thereto. At this time, the RPM of the indoor fan may be increased from the weak wind mode, the strong wind mode, to the turbo mode. For example, the indoor-unit controller 117 may drive a mode set to the minimum RPM of the indoor fan during the first time among a plurality of modes based on the RPM of the indoor fan set in the air conditioner 100, and may change the mode to a mode other than the mode set to the minimum RPM during the second time.

Meanwhile, the indoor-unit controller 117 may maintain the indoor fan 114 in a stop state for the first time when the compressor 133 is turned off, and may drive the indoor fan 114 at a predetermined RPM for the second time when the first time is exceeded.

In this case, when a plurality of indoor fans is provided, the indoor-unit controller 117 may set the RPMs of the plurality of indoor fans such that the indoor fan disposed at a lower side among the plurality of indoor fans has the greater value of RPM when the indoor fan 114 is operated at the predetermined RPM.

Figure 7:
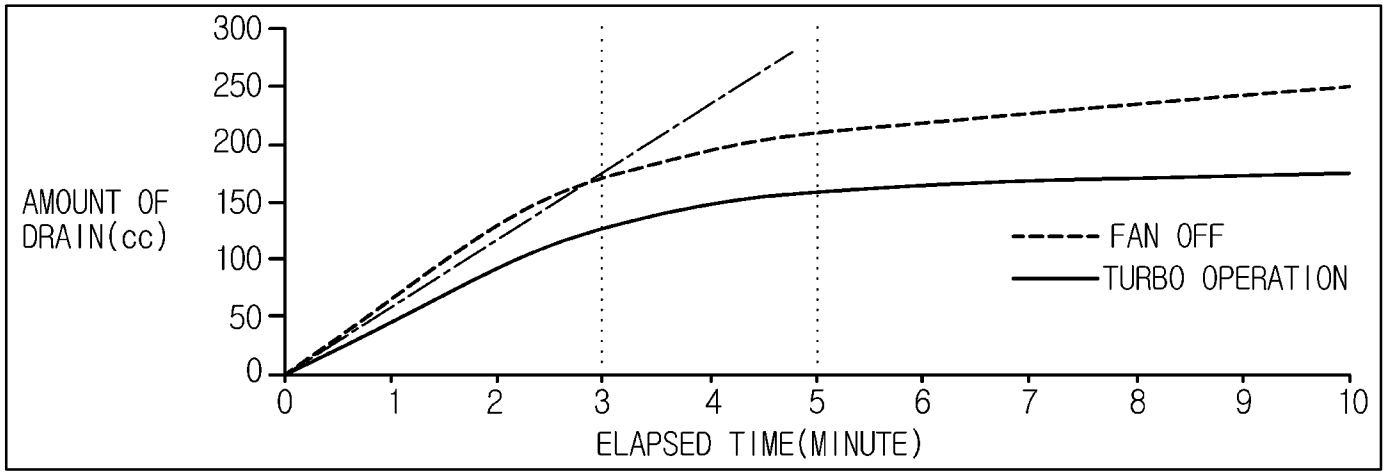
FIG. 7 is a view illustrating a time for changing the revolutions per minute of the indoor fan.

FIG. 7 is a view illustrating the amount of drainage per elapsed time.

Referring to FIG. 7, the point at which the natural drainage of the condensate per hour is the maximum (when the fan is in the off state in FIG. 7) may be between two minutes and three minutes. Referring to this, the indoor-unit controller 117 may control natural drainage rather than the indoor fan 114 when the natural drainage amount of the condensate is relatively large. In addition, the indoor-unit controller 117 may set the first time for operating the indoor fan 114 at the minimum RPM or for stopping the operating to 3 minutes with reference to FIG. 7, although not limited to these.

Table 1 is a table illustrating the results of the odor evaluation at the time of control of the indoor fan in the conventional art (before the change) and the disclosed disclosure (after the change) of the present disclosure, and Table 2 is a table illustrating the description according to the odor intensity. Table 1 shows an example in which only the lower indoor fan of the indoor fans of the first embodiment of FIG. 8 to be described later is operated at the minimum RPM for the predetermined time, and then the plurality of indoor fans are operated.

Table 1 illustrates the evaluation of the odor intensity before and after the change of the six odor evaluation panels (A to F).

As shown in Table 1, it can be confirmed that the present disclosure has an average odor intensity perceived by the user is lowered by 0.8 as compared with the conventional art.

TABLE 1

| | Item | | | | | | | |
|---|---|---|---|---|---|---|---|---|
| | A | B | C | D | E | F | Average | Deviation |
| Before change | — | 2.0 | 2.0 | 2.0 | 2.0 | 1.0 | 1.8 | 0.44 |
| After change | 1.0 | 1.5 | — | 1.5 | 0.5 | 0.5 | 1.0 | 0.50 |

TABLE 2

| Odor intensity | Odor strength | Explanation |
|---|---|---|
| 0 | Odorless | Relatively odorless state that can't detect anything with normal |
| 1 | Detecting odor | Barely detectable odor |
| 2 | Weak odor | A weak odor that knows what odor |
| 3 | Normal odor | Easily detectable odor |
| 4 | Strong odor | A strong odor |
| 5 | Intense odor | A intense odor |

The communicator 131 may be configured to transmit and receive power and communication signals between the indoor unit 110 and the outdoor unit 130.

The storage 132 may be configured to store various sets and control information related to the operation of the air conditioner 100.

The storage 132 may be implemented as at least one of a non-volatile memory device (for example, a cache, ROM, PROM, EPROM, EEPROM, and flash memory), a volatile memory device (for example, RAM), or storage medium (for example, HDD and CD-ROM)), although not limited to these. The storage 132 may be memory implemented as a separate chip from the processor described above in regard of the controller, or the storage device and the processor may be integrated into a single chip.

The compressor 133 may be configured to compress the refrigerant into the high-temperature high-pressure gaseous refrigerant.

The operation related information including the on or off state of the compressor 133 may be transmitted to the indoor unit 110 through the communicator 131.

The outdoor fan 134 may be configured to forcibly blow the outdoor air by the outdoor fan motor 15 (see FIG. 1) so that heat-exchange is performed in the outdoor heat-exchanger 13 (see FIG. 1).

The outdoor fan 134 may change the RPM of the outdoor fan 132 according to the control signal transmitted from the outdoor-unit controller 137.

The electronic expansion valve 135 may be configured to decompress and expand the heat-exchanged refrigerant while adjusting the refrigerant flow rate.

The temperature sensor 136 may be configured to detect the outdoor temperature. The temperature sensor 136 may be installed anywhere the temperature of the outdoor air can be detected.

The outdoor-unit controller 137 may be configured to control the operation of the configuration in the outdoor unit 130 and may transmit and receive the information for control with the outdoor unit 110 through the communicator 131.

The indoor-unit controller 117 and the outdoor-unit controller 137 may be implemented with memory (not shown) to store data for algorithms for controlling the operations of components in the air conditioner 100 or programs for executing the algorithms, and a processor (not shown) to perform the above-described operations using the data stored in the memory. The memory and the processor may be implemented as separate chips, or integrated into a single chip.

At least one component may be added or deleted corresponding to the performance of the components in the air conditioner 100 shown in FIG. 2. It will be readily understood by those skilled in the art that the mutual position of the components may be changed corresponding to the performance or structure of the system.

Meanwhile, each component shown in the air conditioner 100 may implement a hardware component, such as software and/or a Field Programmable Gate Array (FPGA), and an Application Specific Integrated Circuit (ASIC).

Figure 8:
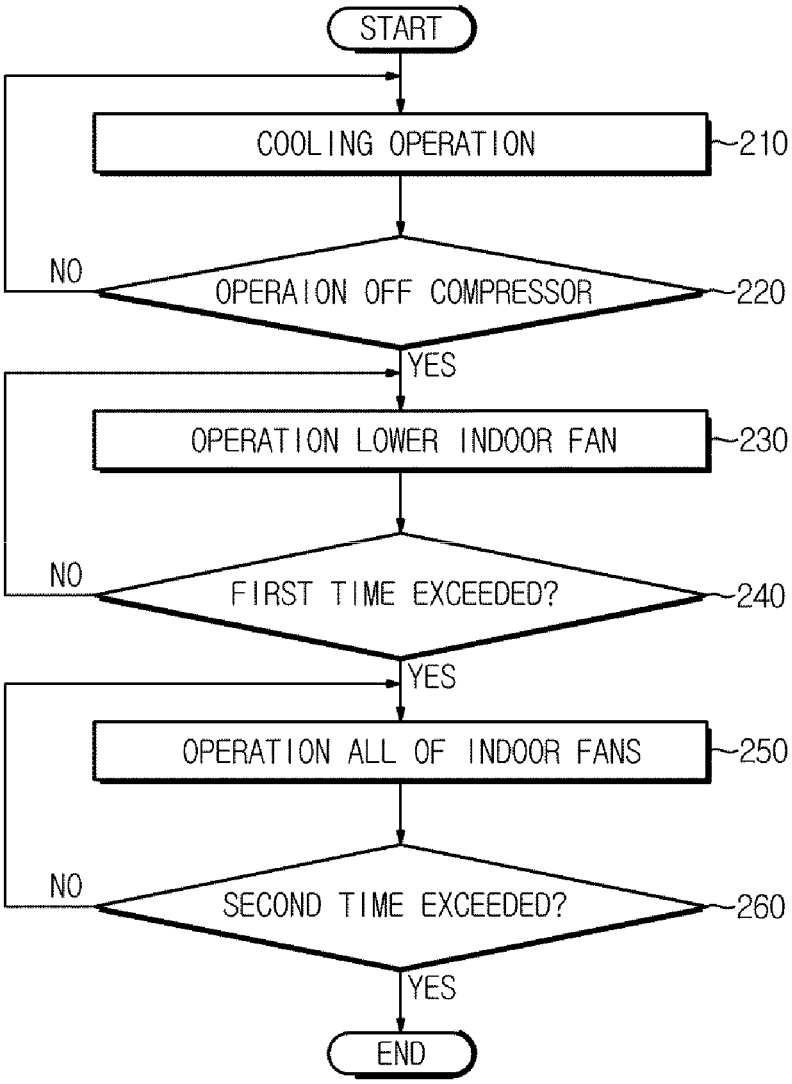
FIG. 8 is a flowchart illustrating a first embodiment of the air conditioner control method.

FIG. 8 is a flowchart illustrating a first embodiment of the air conditioner control method, in which the case of the plurality of indoor fans will be described as an example. At this time, the indoor fans may be vertically arranged, but is not limited thereto.

Referring to FIG. 8, the air conditioner 100 may perform the cooling operation (210).

Next, when the compressor 133 (see FIG. 2) is turned off, the air conditioner 100 may change and control the RPM of the indoor fan to the predetermined time. At this time, the off operation of the compressor 133 may be generated when the target temperature is reached (Thermo Off) or when the off command is inputted by the user's operation, although not limited to these.

Particularly, when the compressor 133 is turned off (220), the air conditioner 100 may operate only the predetermined lower indoor fan 114*a* of the indoor fans 114*a* to 114*c* of FIG. 3 (230) for the first time. For example, the first time may be three minutes, but is not limited thereto.

The air conditioner 100 may operate the lower indoor fan 114*a* at the minimum RPM when operating only the lower indoor fan 114*a* of FIG. 3. In this case, the minimum RPM implements a smallest RPM among the RPMs of the indoor fans preset in the air conditioner 100, and may be changed according to the needs of the operator.

When the first time is exceeded (240), the air conditioner 100 may operate the plurality of indoor fans (114*a* to 114*c* of FIG. 4) for the second time (250, and 260). At this time, the second time may be 7 minutes, but is not limited thereto.

The air conditioner 100 may set the RPMs of the plurality of indoor fans (114*a* to 114*c* of FIG. 4) such that an indoor fan disposed at a lower side among the plurality of indoor fans has the greater value of RPM when operating the plurality of indoor fans (114*a* to 114*c* of FIG. 4). For example, the air conditioner 100 may set and control the size of the RPM as large→medium→small corresponding to one of the indoor fans 114*a*, 114*b*, and 114*c*, in order in FIG. 4.

Figure 9:
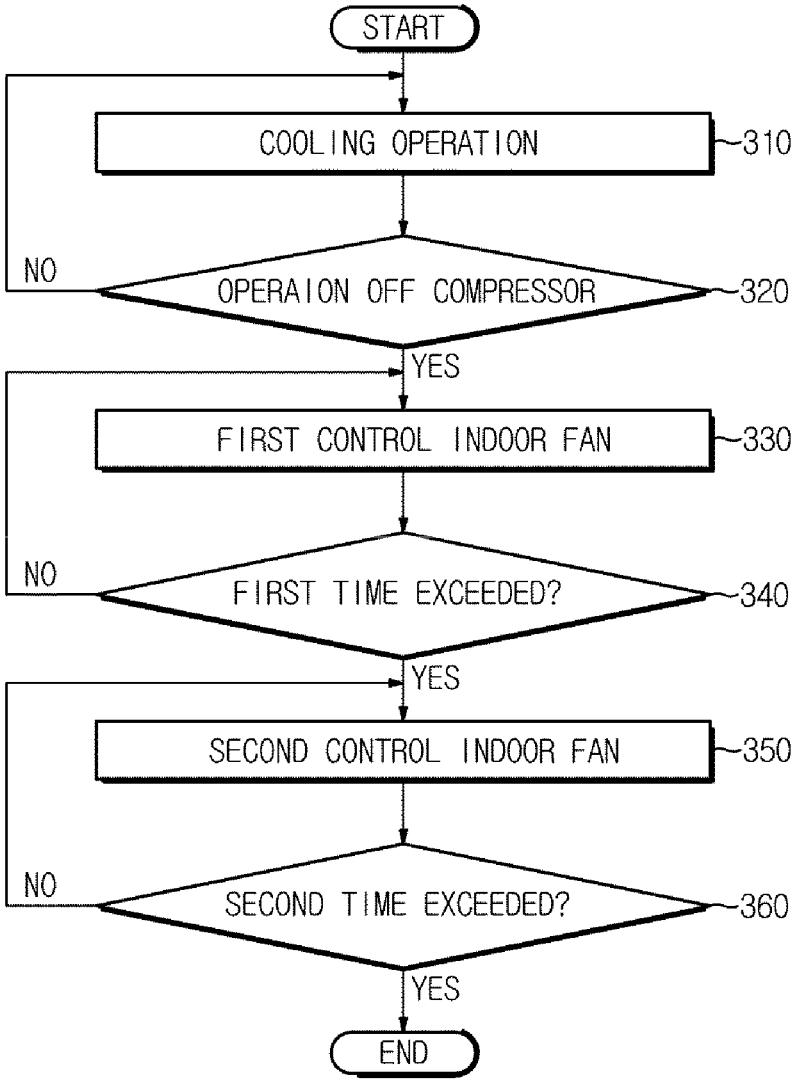
FIG. 9 is a flowchart illustrating a second embodiment of the air conditioner control method.

FIG. 9 is a flowchart illustrating a second embodiment of the air conditioner control method, in which the case where a single indoor fan 114 is provided will be described as an example.

Referring to FIG. 9, the air conditioner 100 may perform the cooling operation (310).

Next, when the operation of the compressor 133 (see FIG. 2) is turned off, the air conditioner 100 may change and control the RPM of the indoor fan to the predetermined time.

Particularly, when the compressor 133 is turned off (320), the air conditioner 100 may operate the indoor fan 114 at the minimum RPM for the first time.

At this time, the air conditioner 100 may operate the indoor fan 114 in the weak wind mode for the first time.

Next, when the first time is exceeded (340), the air conditioner 100 may operate the indoor fan 114 for the second time with a value larger than the minimum RPM (350, and 360).

At this time, the air conditioner 100 may operate the indoor fan 114 in the strong wind mode or the turbo mode for the second time. The RPM of the indoor fan may be increased from the weak wind mode, the strong wind mode, to the turbo mode, in order.

Figure 10:
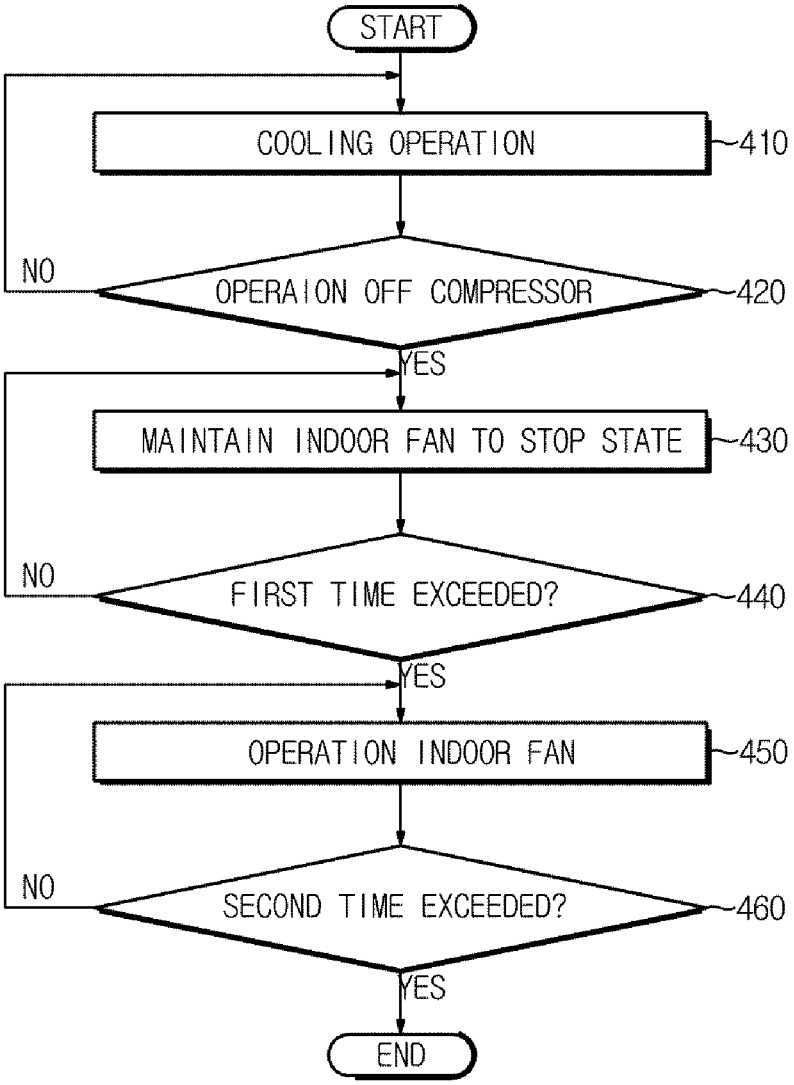
FIG. 10 is a flowchart illustrating a third embodiment of the air conditioner control method.

FIG. 10 is a flowchart illustrating a third embodiment of the air conditioner control method.

Referring to FIG. 10, the air conditioner 100 may perform the cooling operation (410).

Next, when the compressor 133 (see FIG. 2) is turned off (420), the air conditioner 100 may maintain the indoor fan 144 (see FIG. 2) in the stop state for the first time (430).

When the first time is exceeded (440), the air conditioner 100 may operate the indoor fan 114 at the predetermined RPM for the second time (450, and 460).

When the plurality of the indoor fans 114 is provided, the air conditioner 100 may set the RPMs of the plurality of indoor fans such that an indoor fan disposed at a lower side among the plurality of indoor fans has the greater value of RPM when the indoor fan 114 is operated at the predetermined RPM in step 450.

For example, in step 450, the air conditioner 100 may control the plurality of indoor fans at the same RPM, or only a part of the plurality of indoor fans is operated at a minimum RPM for the predetermined time, and then may operate the plurality of indoor fans.

The present disclosure may be implemented during the automatic cleaning after the compressor of the air conditioner is turned off, but is not limited thereto, and it is natural that it is a technique that may be applied according to the turning off of the air conditioner.

As is apparent from the above description, the air conditioner and the method for controlling the same according to the embodiments of the present disclosure can smoothly drain and evaporate the condensate remaining in the indoor heat-exchanger through the control of changing the revolutions per minute of the indoor fan after the compressor is off so that it is possible to prevent the spread of the unpleasant odor which may occur due to evaporation of the condensate.

Meanwhile, the embodiments of the present disclosure may be implemented in the form of recording media for storing instructions to be carried out by a computer. The instructions may be stored in the form of program codes, and when executed by a processor, may generate program modules to perform operation in the embodiments of the present disclosure. The recording media may correspond to computer-readable recording media.

The computer-readable recording medium includes any type of recording medium having data stored thereon that may be thereafter read by a computer. For example, it may be a ROM, a RAM, a magnetic tape, a magnetic disk, a flash memory, an optical data storage device, etc.

The exemplary embodiments of the present disclosure have thus far been described with reference to accompanying drawings. It will be obvious to people of ordinary skill in the art that the present disclosure may be practiced in other forms than the exemplary embodiments as described above without changing the technical idea or essential features of the present disclosure. The above exemplary embodiments are only by way of example, and should not be interpreted in a limited sense.

What is claimed is:

1. An air conditioner comprising:

a compressor;

a plurality of indoor fans configured to blow an indoor air, the plurality of indoor fans being arranged in series in a vertical direction; and a controller configured to change a revolutions per minute (RPM) of the plurality of indoor fans at a predetermined time interval when the compressor is turned off, wherein the controller is further configured to operate a lower indoor fan of the plurality of indoor fans, which is located lowest of the plurality of indoor fans, for a first time when the compressor is turned off, and operate the plurality of the indoor fans for a second time when the first time is exceeded and the compressor is still turned off.

2. The air conditioner according to claim 1, wherein the controller operates the lower indoor fan at a minimum RPM when only the lower indoor fan is operated.

3. The air conditioner according to claim 1, wherein the controller sets the RPMs of each of the plurality of indoor fans such that a respective RPM becomes higher for an indoor fan disposed below in an arrangement of the plurality of indoor fans when the plurality of indoor fans are operated for the second time.

4. The air conditioner according to claim 1, wherein the controller operates at least one indoor fan of the plurality of indoor fans at a minimum RPM for the first time when the compressor is turned off, and operates the at least one indoor fan according to a value larger than the minimum RPM for the second time when the first time is exceeded.

5. The air conditioner according to claim 4, wherein the controller operates the at least one indoor fan in a weak wind mode for the first time, and operates the at least one indoor fan in a strong wind mode or a turbo mode for the second time.

6. An air conditioner comprising:

a compressor;

a plurality of indoor fans configured to blow an indoor air; and a controller configured to:

maintain the plurality of indoor fans in a stop state for a first time when the compressor is turned off, operate a number of the plurality of indoor fans less than a total number of the plurality of indoor fans at a minimum revolutions per minute (RPM) for a second time when the first time is exceeded and the compressor is still turned off, and operate the plurality of indoor fans at a predetermined RPM for a third time when the second time is exceeded and the compressor is still turned off.

7. The air conditioner according to claim 6, wherein the plurality of indoor fans are arranged in series in a vertical direction, and wherein the controller sets the RPMs of each of the plurality of indoor fans such that a respective RPM becomes higher for an indoor fan disposed below in an arrangement of the plurality of indoor fans when the plurality of indoor fans are operated for the third time.

8. A method for controlling an air conditioner comprising:

performing a cooling operation; and changing a revolutions per minute (RPM) of a plurality of indoor fans at a predetermined time interval when a compressor is turned off, wherein the plurality of indoor fans are arranged in series in a vertical direction, and wherein the changing the RPM of the plurality of indoor fans comprises:

operating a lower indoor fan of the plurality of indoor fans, which is located lowest of the plurality of indoor fans, for a first time when the compressor is turned off; and operating the plurality of indoor fans for a second time when the first time is exceeded and the compressor is still turned off.

9. The method according to claim 8, wherein the changing the RPM of the plurality of indoor fans further comprises:

operating the lower indoor fan at a minimum RPM when only the lower fan is operated.

10. The method according to claim 8, wherein the changing the RPM of the plurality of indoor fans further comprises:

setting the RPMs of each of the plurality of indoor fans such that a respective RPM becomes higher for an indoor fan disposed below in an arrangement of the plurality of indoor fans when the plurality of indoor fans is operated for the second time.

11. The method according to claim 8, wherein the changing the RPM of the plurality of indoor fans comprises:

operating at least one indoor fan of the plurality of indoor fans at a minimum RPM for the first time, and operating the at least one indoor fan to a value larger than the minimum RPM for the second time when the first time is exceeded.

12. The method according to claim 11, wherein:

the operating of the at least one indoor fan at the minimum RPM for the first time comprises operating the at least one indoor fan in a weak wind mode for the first time, and the operating of the at least one indoor fan to the value larger than the minimum RPM for the second time comprises operating the at least one indoor fan in a strong wind mode or a turbo mode for the second time.

13. A method for controlling an air conditioner comprising:

performing a cooling operation;

maintaining a plurality of indoor fans in a stop state for a first time when a compressor is turned off;

operating a number of the plurality of indoor fans less than a total number of the plurality of indoor fans at a minimum revolutions per minute (RPM) for a second time when the first time is exceeded and the compressor is still turned off; and operating the plurality of indoor fans at a predetermined RPM for a third time when the second time is exceeded and the compressor is still turned off.

14. The method according to claim 13, wherein the plurality of indoor fans are arranged in series in a vertical direction, and wherein the operating of the plurality of indoor fans at the predetermined RPM comprises:

setting the RPMs of each of the plurality of indoor fans such that a respective RPM becomes higher for an indoor fan disposed below in an arrangement of the plurality of indoor fans when the plurality of indoor fans are operated for the third time.

* * * * *